United States Patent [19]

Laporte et al.

[11] 4,288,080

[45] Sep. 8, 1981

[54] APPARATUS FOR TARGET PRACTICE

[75] Inventors: Jean C. Laporte; Jean M. Laporte, both of Biot, France

[73] Assignee: S.A.R.L. Laporte Cibelec, Antibes, France

[21] Appl. No.: 105,241

[22] Filed: Dec. 19, 1979

[51] Int. Cl.[3] ..... F41J 7/00

[52] U.S. Cl. ..... 273/406

[58] Field of Search ..... 273/406

[56] References Cited

U.S. PATENT DOCUMENTS 2,063,284 12/1936 Winans .
2,706,634 4/1955 Van Valkenburg ..... 273/406
3,225,754 12/1965 Foster .
4,077,384 3/1978 Montefeltro .

FOREIGN PATENT DOCUMENTS 1200173 9/1965 Fed. Rep. of Germany ..... 273/406
1125504 7/1956 France .
365009 10/1962 Switzerland .
415364 6/1966 Switzerland .

*Primary Examiner*—Paul E. Shapiro
*Attorney, Agent, or Firm*—Young & Thompson

[57] ABSTRACT

Apparatus for target practice comprises a parallelpipedal body containing a motor, and a drive shaft emerging from the body and carrying a crank. Swingably mounted on the body is a shaft having cross arms thereon, one of which is connected by a link to the crank and the others of which can selectively receive a target for holding the target swingably or pivotally in positions spaced apart 90°. A switch for controlling the motor coacts with the crank such that rotation of the crank is limited to 180°, which in turn rotates the arm bearing the target through 90°. Depending on the position of the body and the selection of a socket for the target on the rotating arm, the target can be swung or pivoted, to and from any of a variety of positions of orientation.

3 Claims, 10 Drawing Figures

FIG_7
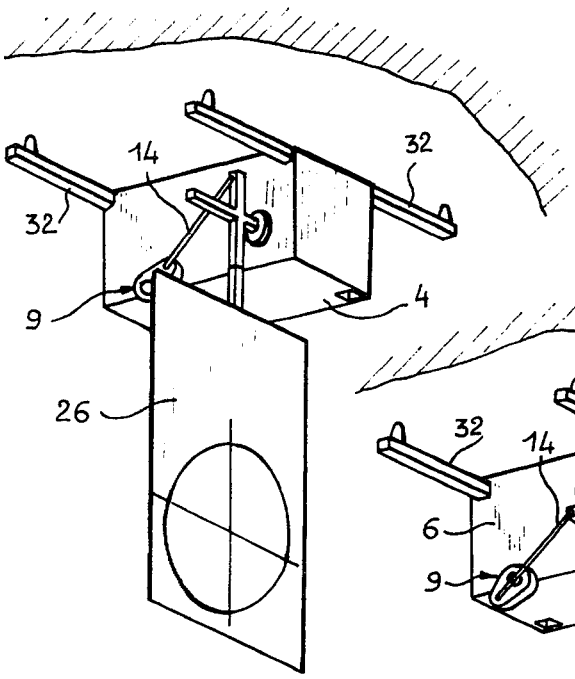
FIG_8
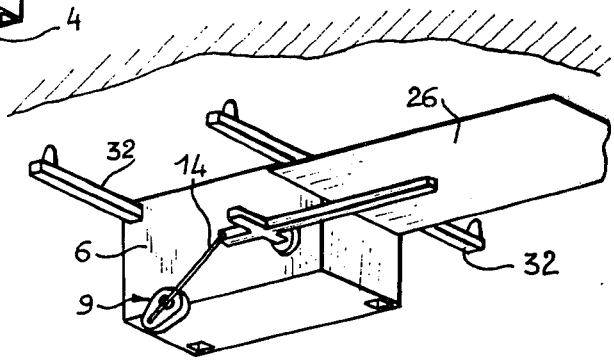
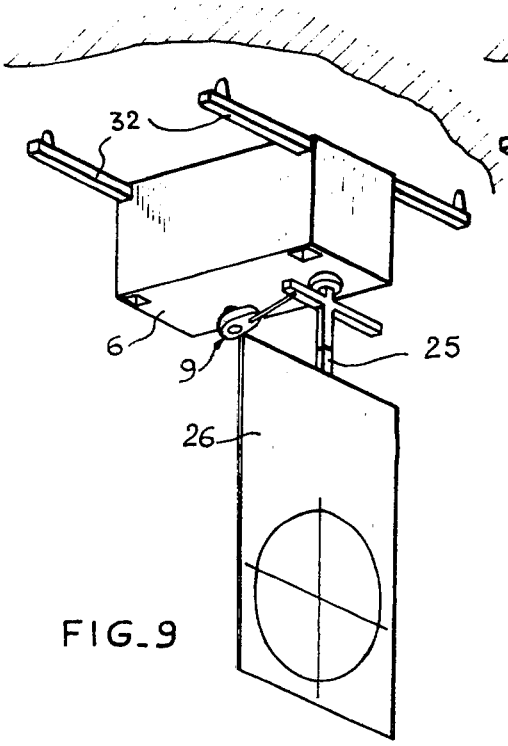
FIG_9
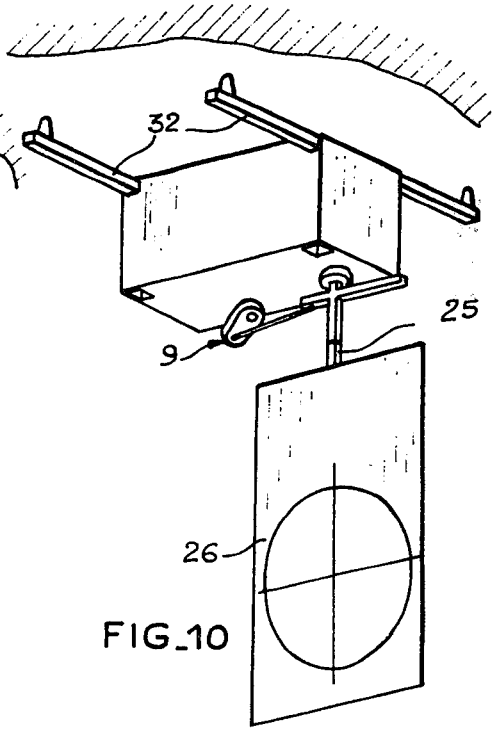
FIG_10

APPARATUS FOR TARGET PRACTICE

The present invention relates to apparatus for target practice.

Devices are known which comprise an electrical motor whose output shaft extends horizontally and carries a support for a target such that the target may be raised vertically for firing and swung to a horizontal position behind a protective wall for changing the target.

Another type of device is known in which the target is carried on a vertical axle and may thus occupy either of two positions spaced apart by 90°, namely, a firing position in which it is perpendicular to the line of fire, and an inactive position in which it is edgewise to the line of fire.

With these two arrangements corresponding to two different modes of target practice, it is necessary to provide two different devices.

An object of the present invention is to provide apparatus which permits use selectively for either one of these two modes of operation, the apparatus being very simple and lightweight.

The present invention is a device for target practice, of the type comprising a body enclosing a motor driving a shaft that receives a support for the target, and is characterized in that the body comprises means for positioning it to occupy various positions that differ from each other by 90°, namely, a first position in which the shaft extends substantially horizontally and a second position in which the shaft extends substantially vertically. Thanks to this arrangement, the apparatus may, when the shaft is horizontal, be used for vertically swinging targets; while when the shaft is vertical, the target merely pivots and thus can be positioned selectively broadside or edgewise.

According to a more particular feature, the shaft has a cross bar, the target support being selectively mountable on the cross bar or on the shaft.

According to another feature of the construction of the device, the body has a generally parallelpipedal form having four lateral sides and two end faces, the shaft projecting from one of the lateral sides, which one side and its opposite parallel side are interconnected by first transverse passageways, the two other lateral sides having second lateral passageways, support rods being selectively engageable in the first or second transverse passageways. So as to level the body, the support rods are provided with screws adjacent each of their ends.

Finally, according to a particular constructional characteristic, the motor is an electric motor with a suitable drive circuit having a control switch in a holding circuit and a switch for opening the holding circuit, the motor comprising, secured to its output shaft, a crank having two lobes spaced apart 180°, one of which carries a crank pin connected by a link to an arm secured to the shaft that receives the target support and extending perpendicular to that shaft, the switch for opening the circuit being actuated by the crank lobes so that for each rotation of the motor output shaft through 180°, the shaft carrying the target will be rotated 90°. Thus, there is provided a device which is very simple and in which the electric motor always turns in the same direction and in which the moving parts are reduced to the bare minimum.

The invention will now be described in greater detail with reference to several embodiments given solely by way of example and shown in the accompanying drawings.

In the drawings:

FIGS. 7 and 8 show a further manner of use of the invention; and FIGS. 9 and 10 show a still further manner of use of the invention.

Figure 1:
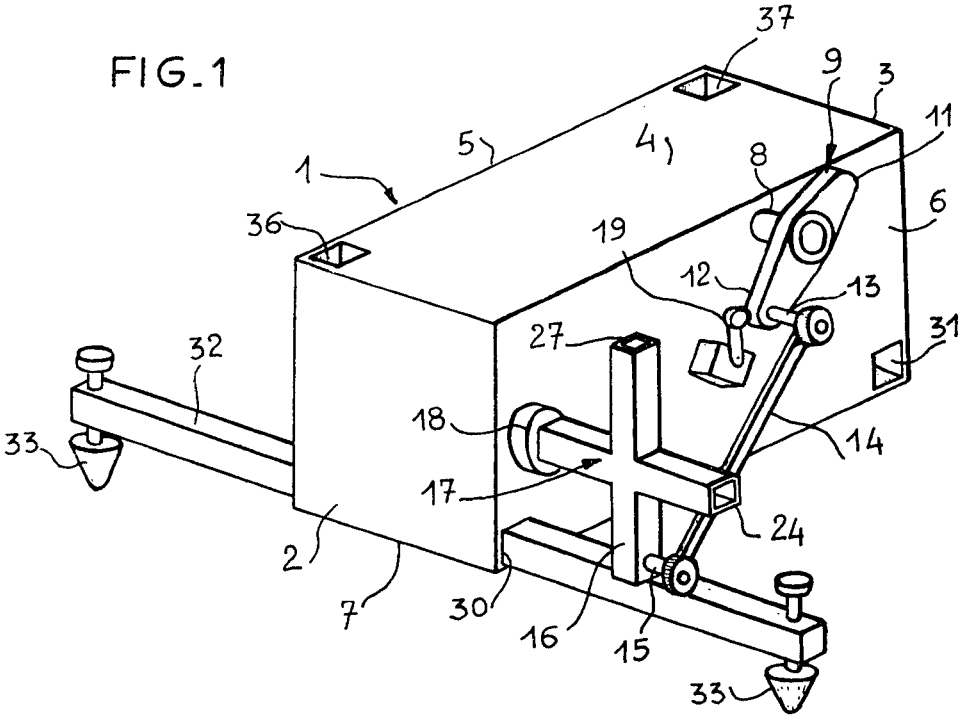
FIG. 1 is a perspective view of a device according to the invention.

The device shown in FIG. 1 comprises a body 1 of generally parallelpipedal form having two end faces 2 and 3 and four lateral sides 4, 5, 6 and 7.

From side 6 projects the output shaft 8 of an electric motor (not shown) housed within body 1. A crank 9 is secured on shaft 8 and has two lobes 11 and 12 spaced apart 180°.

On crank 9 is mounted a crank pin 13 on which is pivotally mounted one end of a link 14 whose other end is pivotally mounted on a pin 15 carried by a cross arm 16 integral with shaft 17 which turns in bearing 18 on body 1.

Figure 2:
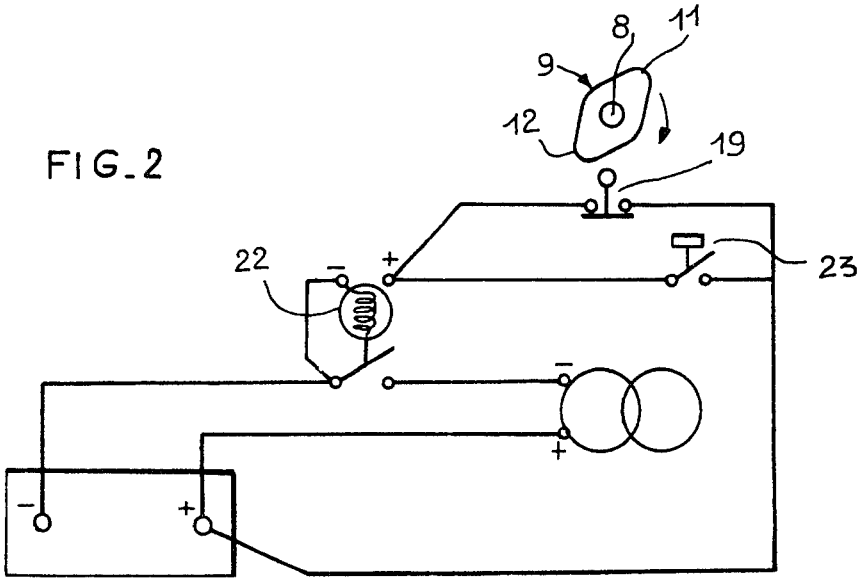
FIG. 2 is the electric circuit diagram of the device.

On side 6 is mounted a switch 19 which is activated by lobes 11 and 12. As shown in FIG. 2, the drive motor is connected in a circuit containing a holding relay 22 and a manually operated normally open control switch 23, the relay 22 closing the motor circuit such that the shaft 8 is driven until the lobe 11 or 12 bears against switch 19 which is thus opened so that the relay 22 is no longer activated, thus opening the motor circuit.

Shaft 17 terminates in a square socket 24 that receives a rod 25 of corresponding cross section, supporting a target 26.

Shaft 17 comprises a hollow cross arm 27 aligned with arm 16 and adapted to receive support rod 25.

The sides 5 and 6, adjacent side 7, are traversed by passageways 30 and 31 in which are engageable support rods 32, the latter having adjustment screws 33 at their ends.

Sides 4 and 7, adjacent side 4, are traversed by passageways 36 and 37 which can selectively receive rods 32.

Figure 3:
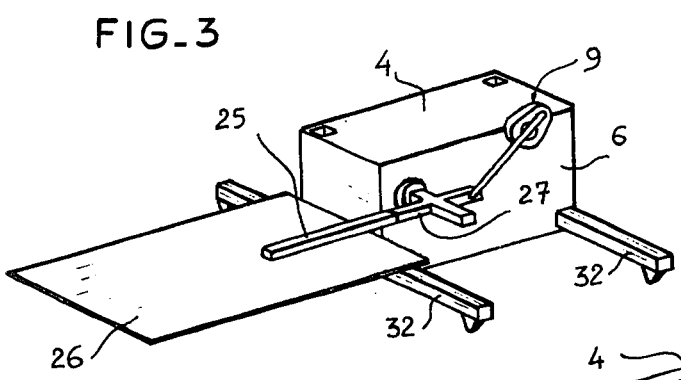
FIGS. 3 and 4 show a first manner of use of the device of the invention.
Figure 4:
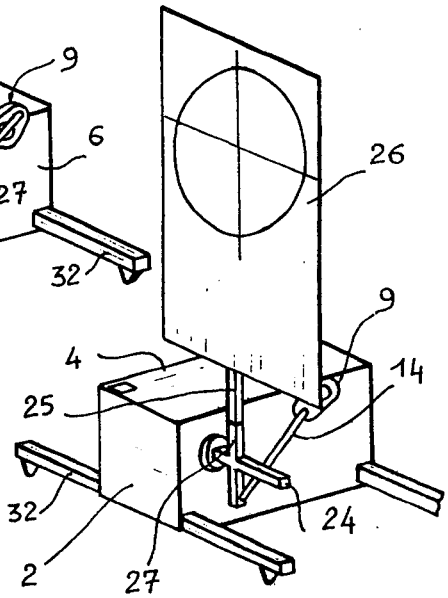

As will be seen in FIGS. 3 and 4, the length of the arm 16, the link 14 and the crank 9, is such that for a rotation of 180° of shaft 8, shaft 17 turns 90°. Thus, in the case of FIG. 1, when the lobe 12 encounters switch 19, arm 16 is disposed vertically; while when the lobe 11 opens the switch 19, the arm 16 is horizontal.

FIGS. 3 and 4 show the use of the device for a vertically swinging target. In this case, rod 25 is disposed in hollow arm 27.

Figure 5:
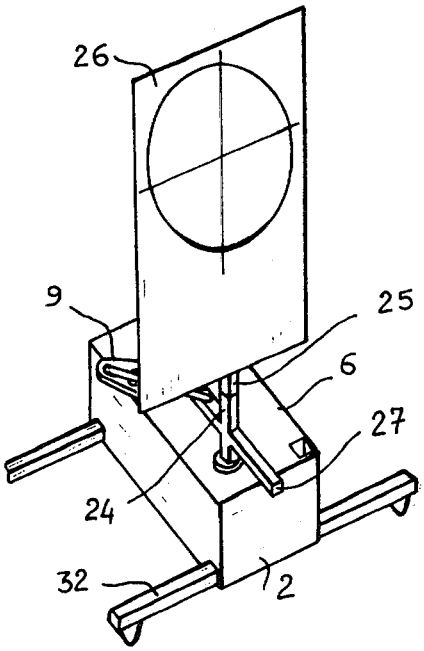
FIGS. 5 and 6 show a second manner of use of the device of the invention.
Figure 6:
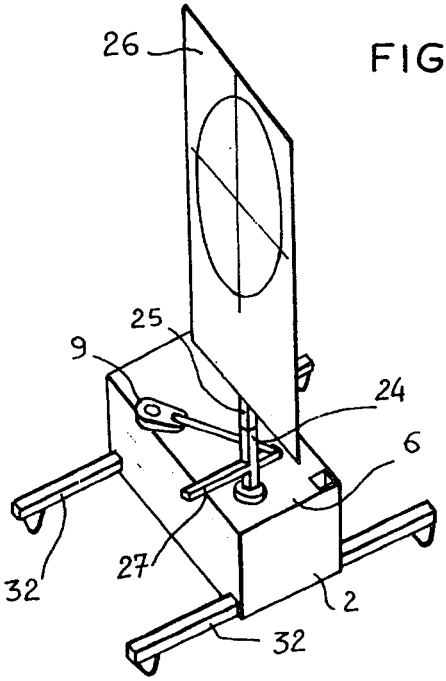

FIGS. 5 and 6 show the device in position to pivot the target. In this case, the rods 32 are disposed in passageways 36 and 37 so that the shaft 17 will be vertical, the rod 25 being in this case mounted in socket 24.

It is also possible (see FIGS. 7 and 8) to secure the device to a ceiling for mounting the target in a position to swing vertically, or to pivot the target as seen in FIGS. 9 and 10.

Of course, the invention is not limited to the embodiments which have been shown and described, as a number of modifications can be adopted without thus departing from the scope of the invention. In particular, the target 26 could, in the embodiment of FIGS. 3 and 4, be displaced by an angle of 90° about the axis of rod 25. Similarly, in the case of a vertically swinging target, a rod 25 can be used which is elbowed and whose free end is engaged in square socket 24.

What is claimed is:

1. Apparatus for target practice, comprising a body enclosing a motor that drives a shaft that supports a target, means for mounting the body on a support selectively in either of two positions spaced apart from each other by 90°, said shaft extending from the body horizontally in one said position and vertically in the other said position, said shaft having a perpendicular cross arm, and means selectively to mount the target either on said shaft or on said cross arm.

2. Apparatus for target practice, comprising a body enclosing a motor that drives a shaft that supports a target, means for mounting the body on a support selectively in either of two positions spaced apart from each other by 90°, said shaft extending from the body horizontally in one said position and vertically in the other said position, the body being parallelpipedal and having four lateral sides and two end faces, the shaft extending through one said lateral face, first transverse passageways through said one face and through the face opposite said one face, and second transverse passageways extending through the other two side faces of the body, said first and second transverse passageways being adapted selectively to receive support rods to support the body selectively in either of said two positions.

3. Apparatus as claimed in claim 2, in combination with support rods selectively engageable in said first or second transverse passageways.

* * * * *